US009328588B2

(12) United States Patent
Loveland

(10) Patent No.: US 9,328,588 B2
(45) Date of Patent: May 3, 2016

(54) GAS GUZZLER

(71) Applicant: WASTE MANAGEMENT, INC., Houston, TX (US)

(72) Inventor: James L. Loveland, Williamsburg, VA (US)

(73) Assignee: Waste Management, Inc., Houston, TX (US)

( * ) Notice: Subject to any disclaimer, the term of this patent is extended or adjusted under 35 U.S.C. 154(b) by 363 days.

(21) Appl. No.: 13/803,940

(22) Filed: Mar. 14, 2013

(65) Prior Publication Data

US 2014/0076541 A1 Mar. 20, 2014

Related U.S. Application Data

(60) Provisional application No. 61/701,153, filed on Sep. 14, 2012.

(51) Int. Cl.

| | |
|---|---|
| ***E21B 41/00*** | (2006.01) |
| ***F24F 7/007*** | (2006.01) |
| ***E21B 33/02*** | (2006.01) |
| ***E21B 43/12*** | (2006.01) |

(52) U.S. Cl.
CPC ..... *E21B 41/0021* (2013.01); *E21B 33/02* (2013.01); *E21B 43/12* (2013.01); *F24F 7/007* (2013.01)

(58) Field of Classification Search
USPC ..... 166/244.1, 75.11; 454/234
See application file for complete search history.

(56) References Cited

U.S. PATENT DOCUMENTS

| | | | | |
|---|---|---|---|---|
| 2,402,669 | A * | 6/1946 | Rubin | 454/36 |
| 3,566,965 | A * | 3/1971 | Solum | 166/241.7 |
| 5,026,219 | A * | 6/1991 | Wallace | 405/303 |
| 6,044,904 | A * | 4/2000 | Shafer | 166/75.13 |
| 6,161,878 | A * | 12/2000 | Atsumi et al. | 285/133.21 |

* cited by examiner

*Primary Examiner* — Taras P Bemko
(74) *Attorney, Agent, or Firm* — McDonnell Boehnen Hulbert & Berghoff LLP

(57) ABSTRACT

A device for directing hazardous gases away from a pipe that is emitting the gases, the device including a split column having a first opening and a second opening at opposing ends of the split column, the split column further including a split that passes through the tubular section and that extends from the first opening to the second opening and a third opening in the split column that is located between the first opening and the second opening.

17 Claims, 4 Drawing Sheets

GAS GUZZLER

This application claims priority to provisional patent application No. 61/701153, filed on Sep. 14, 2012, the specification of which is incorporated herein by reference.

BACKGROUND OF THE INVENTION (1) Field of the Invention

The present invention relates to a device that is associated with gas well heads or portions of damaged gas piping that provides for enhanced worker safety with respect to hazardous gas levels encountered when performing maintenance tasks on hazardous gas containing piping and wells.

(2) Description of the Art

Decomposing materials at landfills produce methane and other valuable gases. It has become common to recover use the valuable components of landfill off gases using gas recovery wells. Landfills, however, are increasingly experiencing higher levels of hydrogen sulfide gas comingled with landfill gas (LFG) at sites across the country. These higher levels of hydrogen sulfide as well as methane and other combustible landfill gases represent a hazard to landfill technicians, contractors and employees as they perform maintenance on LFG recovery wells.

The current practice of installing a gas extraction well in a landfill is to drill a hole into the waste mass and insert a casing bore pipe into the boring (with the lower pipe segment slotted or perforated to allow LFG to enter the pipe from all sides) and solid pipe on the upper segment (to a level 3-4 feet above the surface). Once the pipe is in place the hole is backfilled (excluding the well pipe bore) with stone or gravel to the level of the perforations. Next, a seal is installed to isolate the collection zone (with stone/gravel and perforated pipe) from areas above and backfill the remaining portion of the hole with soil to the surface of the landfill. The bore pipe is then connected to a vacuum source to remove LFG from the bore and adjacent areas and to direct the LFG to recovery processes or to flare.

After installation of a gas extraction well, it is often necessary to perform maintenance on the well such as adding or removing dewatering pumps and in some cases extending the well vertically. These and other maintenance procedures require the operator to temporarily disable the vacuum source to the gas extraction well. When vacuum is not being applied to a gas extraction well, landfill off gases can vent through the open well to the landfill surface in the same area where workers are performing maintenance tasks. The vented gas may contain combustible gases such as methane as well as excessive levels of hydrogen sulfide each of which can cause the work area around the open extraction well to be hazardous.

Hydrogen sulfide ($H_2S$) is especially dangerous. Hydrogen sulfide is a colorless, flammable, extremely hazardous gas with a "rotten egg" smell. It can be both an irritant and chemical asphyxiant and therefore poses a death risk to humans at elevated levels. Hydrogen sulfide gas can be generated in landfills as the result of the decomposition of sulfur bearing wastes following exposure to liquids and organic materials. Because hydrogen sulfide is heavier than air (with a density=1.19 versus air=1.0) it has a tendency to collect in low lying areas such as excavations in waste, poorly-ventilated areas such as leachate collection pump stations and manholes, and may be released from solution in leachate. Hydrogen sulfide can be detected by the human nose at levels as low as 0.0005 ppm. Therefore even very low levels may represent a nuisance odor once it becomes dispersed in the air.

Typically, landfill employees, as well as contractors, working at the landfill on leachate collection or gas collection systems wear personal gas monitoring equipment to detect low oxygen levels and the presence of $H_2S$. They are preset to alarm should $H_2S$ levels at or above 10 ppm be encountered. This alarm level is at 10% of the OSHA determined hazard level of 100 ppm which affords personnel ample time to retreat upwind to areas at lower levels. This protects workers from low level exposure and by design dangerous levels of exposure. Indeed, OSHA has established an acceptable ceiling concentration for exposure for an 8-hour shift of 20 ppm with a maximum peak of 50 ppm.

Since personnel working in close proximity to potential sources of hydrogen sulfide gas will have the greatest potential for exposure, coupled with the fact $H_2$5 is heavier than air, the greatest risk is therefore to workers at the landfill. Therefore, there is a need for devices and methods that keep the area around landfill gas extraction well and other types of gas wells safe while work is being performed on the wells.

SUMMARY OF THE INVENTION

One aspect of this invention is a method for ventilating hazardous gases comprising the steps of: placing a tubular split column having an opening at each end where the opening at the first end is open to the atmosphere and the opening at the second end is sealed around the well bore or gas pipe and a tee with a third gas discharge opening from the side of the split column to allow the attachment of a ventilation duct having a first end and a second end to the discharge opening of the split column such that the ventilation duct first end is associated with the discharge opening and the ventilation duct second end is attached to a gas moving device such as an axial fan. The gas moving device is then engaged and draws air into the split column through the split column first end opening the air entering the split column is drawn into the split column and it sweeps any hazardous gases from around the well pipe through the discharge opening, into the ventilation duct and away from the area of the installed split column.

Another aspect of this invention is a well off gas venting device comprising: a split column having a first opening and a second opening at opposing ends of the split column, the split column further including a split that passes through the tubular section and that extends from the first opening to the second opening; and a third opening in the split column that is located between the first opening and the second opening

DESCRIPTION OF THE INVENTION

The GasGuzzler well off gas venting devices of this invention maintain a safe, non-hazardous environment around a gas well during maintenance or other work on a gas well head, gas well or damaged gas piping. The devices of this invention collect hazardous gasses such as landfill gas (LFG) that would otherwise vent to the work area, and it dilutes and then diverts the collected hazardous gases downwind and away from the work area. In operation, the device creates a safe zone around a gas well or damaged gas pipe where workers can perform the task at hand—while the well is open and possibly venting hazardous gasses without exposing the workers to the hazardous vented off gases.

While the devices and methods of this invention will be described with reference to landfill gas extraction wells and their hazardous gases (LFG). However, the devices can also be used in any other applications where workers face exposure to hazardous gases or gas accumulations. An example of one such application would be in a horizontal orientation where a pressurized hydrocarbon gas pipeline was damaged by construction and is venting gas. The GasGuzzler well off gas venting device could be installed and activated to provide a safe breathing zone that would allow personnel to perform temporary or permanent repairs to the pipeline. The device of this invention will operate under normal wind effects at the work zone.

The devices of this invention ensure that vented gases—the gas flowing from the gas well head or from a damaged pipe portion—is collected and directed a safe distance away from the work zone. The device effectively dilutes the venting gas with air to reduce the concentration of the hazardous gas/air combination prior to venting away from the work zone. Also, portable fans are not typically explosion proof, which could cause other hazards to workers if operated in this type of setting.

The GasGuzzler devices of this invention promote worker safety during work around moderate to high hazard gas (including landfill gas—LFG) at wells or pipelines. The device provides a method to collect gas venting from a typical hydrocarbon containing gas pipe during maintenance or construction activities—or in the case of a LFG well, when the vacuum source is temporarily removed. The gas collected by the device of this invention is directed away from personnel working in the vicinity of the pipe to ensure acceptable levels of atmospheric gases (air) is present for individuals; performing maintenance on the pipe, installing or removing dewatering pumps from a LFG well, or extending the LFG well casing bore pipe vertically (as might be needed to accommodate the placement of additional waste in the landfill area). The device may also be used to dilute any hydrocarbon containing gases that is captures to below explosive levels thereby reducing the risk of explosion or fire during pipeline or well maintenance.

Figure 2:
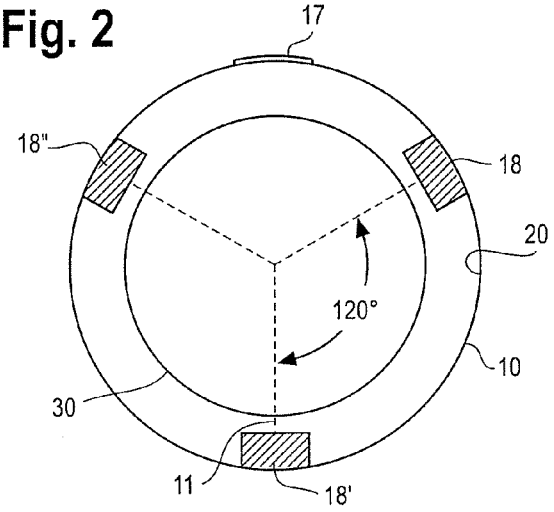
FIG. 2 is top view of a GasGuzzler well off gas venting device embodiment of this invention.
Figure 3:
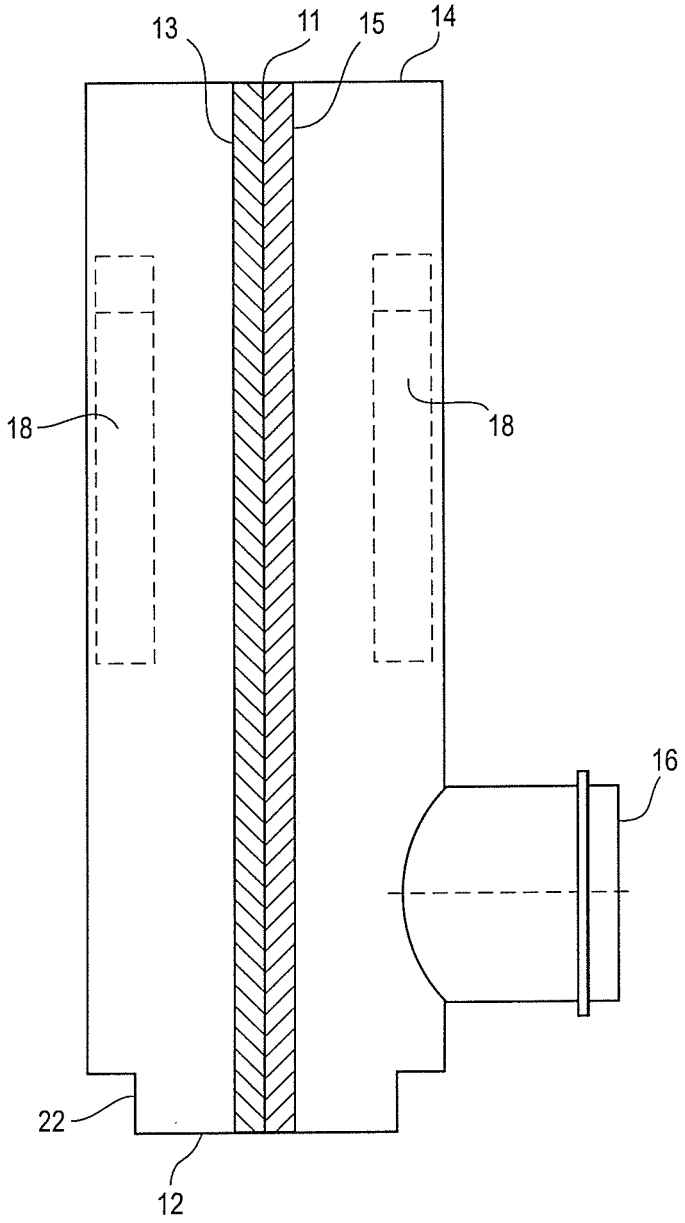
FIG. 3 is side cross-section view of a GasGuzzler well off gas venting device embodiment of this invention.
Figure 4:
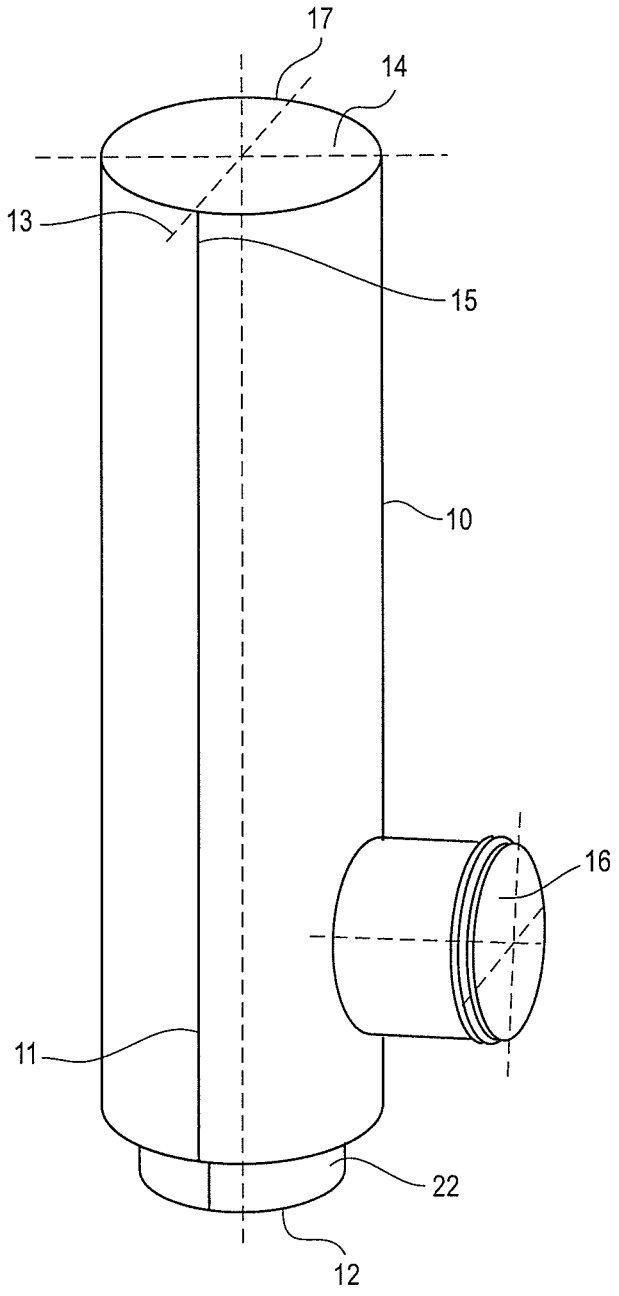
FIG. 4 is a perspective view of a GasGuzzler well off gas venting device embodiment of this invention.
Figure 5A:
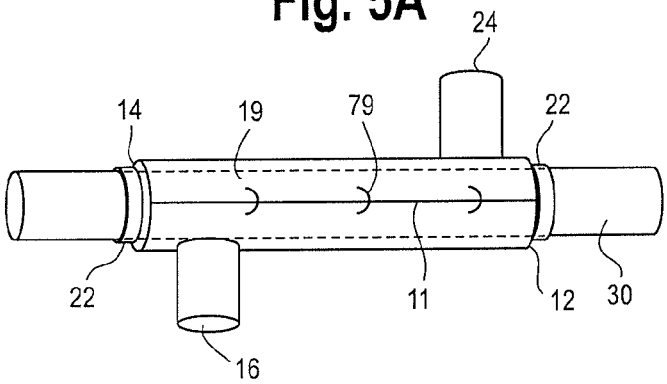
FIGS. 5*a*, 5*b* and 5*c* are examples of GasGuzzler embodiments and how they can be associated with gas well heads and damaged gas piping.
Figure 5B:
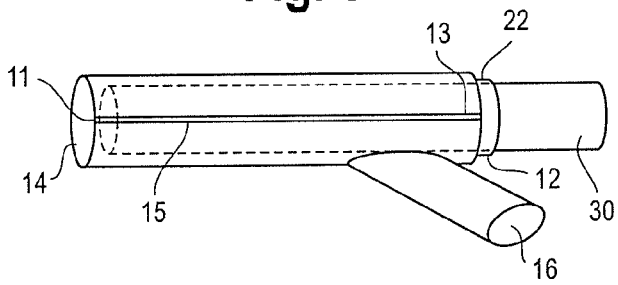

Referring now to FIGS. 2-4, there is shown a GasGuzzler well off gas venting device of this invention that includes a split column (10) having at one end a first opening (12) a second opening that is an air inlet (14) at the second end and, on its side, a third opening that is a discharge opening (16). The split column (10) further includes a split (11) that passes entirely through split column (10) and runs laterally from first opening (12) to air inlet (14). Split (11) allows the first split edge (13) and second split edge (15) of split (11) to be separated from one another by pivoting at hinge (17) to create a gap that allows split column (10) to be placed around a length of piping. In some embodiments, such as that shown in FIG. 5*a*, split column (10) will include a fourth opening (24) that will act as an air inlet or discharge opening.

Hinge (17) may be a mechanical hinge that is incorporated into split column (10) from first opening (12) to second opening (14). Alternatively, split column (10) can be made of a thin resilient plastic material that includes a hinge section that lies about opposite of split (11) that is bendable enough to allow split first and second split edges (13, 15) to be separated widely enough to wrap split column (10) around a gas pipe (30).

Split column (10) may be made from any malleable or solid material such as metals or plastics. Split column (10) will typically be made from a thin gas impervious plastic material that is able to retain its shape when used, but that is bendable enough to allow first split edge (13) and second split edge (15) to be manually separated a distance sufficient to allow split column (10) to be located around a gas extraction pipe and thereafter to have first edge (13), and second edge (15) return to their original position abutting one another and forming split (11) all without breaking or damaging split column (10).

The geometry of split column (10) and its various openings is not critical. The openings can be square, oval, circular, rectangular, or they may have a random perimeter. It is preferred, however, that split column (10) and the various openings are circular due to the availability of circular piping and conduit materials.

One or more closures (19) may be used to direct first split edge (13) and second split edge (15) into contact with one another when split column (10) is in use. When closures (19) are used, one portion of the closure will typically be associated with or near first split edge (13) while a second portion of closure (19) will be associated with or lie adjacent to second split edge (15). Non-limiting examples of useful closures include clamps, hook and loop type fasteners such as Velcro®, rubber bands associated with tabs, screws, hook and eye bolts, plastic latches, combinations thereof and any other closures capable of clamping or engaging the split edges.

Split column (10) may include one or more centralizers (18) located on an inside surface (19) of split column (10). Centralizers (18) function to center split column (10) around the gas pipe to which the split column (10) surrounds. This allows for a more uniform flow of air from air inlet opening (14) to discharge opening (16). Centralizers (18) are three dimensional structures that will generally have a length that is significantly greater that the centralizer width or height. Centralizers (18) will typically be associated on the inside face of split column (10) such that the centralizer lengthwise dimension is oriented axially with respect to first and second openings (12, 14). In order to provide for optimal centering, three centralizers (18, 18' and 18") can be located at approximately 120° intervals around the internal diameter of split column (10) as shown in FIG. 2.

Split column (10) may further include one or more optional seals (22). In one embodiment, seal (22) will be associated with or integral to split column (10) at or near first opening (12). The split columns shown in FIGS. 3-4 include a seal (22) in the form of a pipe reducer portion that causes the radius of inside surface (20) of split column (10) to be about the same as the radius of outer surface of gas pipe (30) thereby creating seal at first opening (12) when split column (10) is placed around gas pipe (30). The seal (22) ensures a proper seal is made between split column (10) and the well bore pipe (30) thereby preventing air leakage from one end (the lower end in a vertical installation) and forcing all induced air flow to pass by the top of the well casing pipe to sweep the LFG released down the column.

Figure 5C:
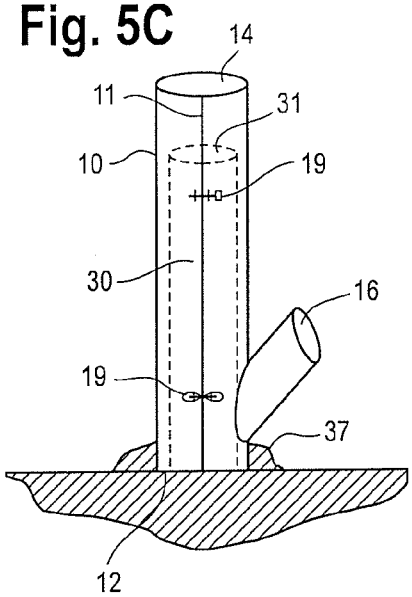

In another alternative shown in FIG. 5*c*, a dirt or clay seal (37) is mounded around first opening (12) when split column (10) is placed around a gas pipe (30) that is emerging vertically from the ground.

The GasGuzzler well off gas venting devices of this invention are typically used by positioning the device to encapsulate a segment of gas pipe that is horizontal or vertical at the point of damage or breach or more preferably for around a vertical section of gas pipe (30) that includes a well head (31). In this preferred installation, split column (10) will be oriented such that the second opening or air inlet opening (14) lies above the point where the gas well pipe terminates at the well head (31). That way, when the well head (not shown) is removed, the open end (31) of gas well pipe (30) lies within the cavity created by split column (10). This is done to ensure that dilution air is pulled past one end of the device, nearest to the pipe opening or breach, for maximum effectiveness of the device and directing the movement of dilution air and any gas emanating from the open end (31) of gas well pipe (30) downward or along the pipe to discharge opening (16). In one embodiment, discharge opening (16) is a 90-degree tee/elbow discharge near the bottom of the split column as shown in FIGS. 3 that directs the induced gas flow away from the well. The dilution air movement is induced with an air moving device (28) such as a blower, vacuum pump or preferably an explosion proof axial exhaust fan and exhausted through an optionally electrically conductive and grounded ventilation duct (26) that is associated at a second end (29) with the air moving device (28) and at the first end (27) with discharge opening (16). Air moving device (28) pulls the hazardous gas/dilution air blend away from the work zone or damage zone inside or near split column (10), through ventilation duct (26) and discharges the diluted hazardous gas at a safe distance away and preferably downwind from workers who are engaged in activity in the work zone or damage zone.

While the device of this invention can be used on any hazardous gas extraction well to improve worker's safety, it is especially targeted as a solution for LFG well maintenance when levels of hydrogen sulfide are excessive. It could also be used on other gas piping in a horizontal application where an open pipe condition exists and potentially hazardous gas levels require removal from the work area.

The GasGuzzler well off gas venting devices are portable and can readily be installed on any typical sized landfill gas (LFG) well in a matter of moments. Both installation and removal are possible from ground level (even if the extension is many feet in length). The split column can be manufactured in various sizes—lengths and diameters as well as opening diameters and orientations to accommodate varied pipeline and well casing sizes.

Figure 1:
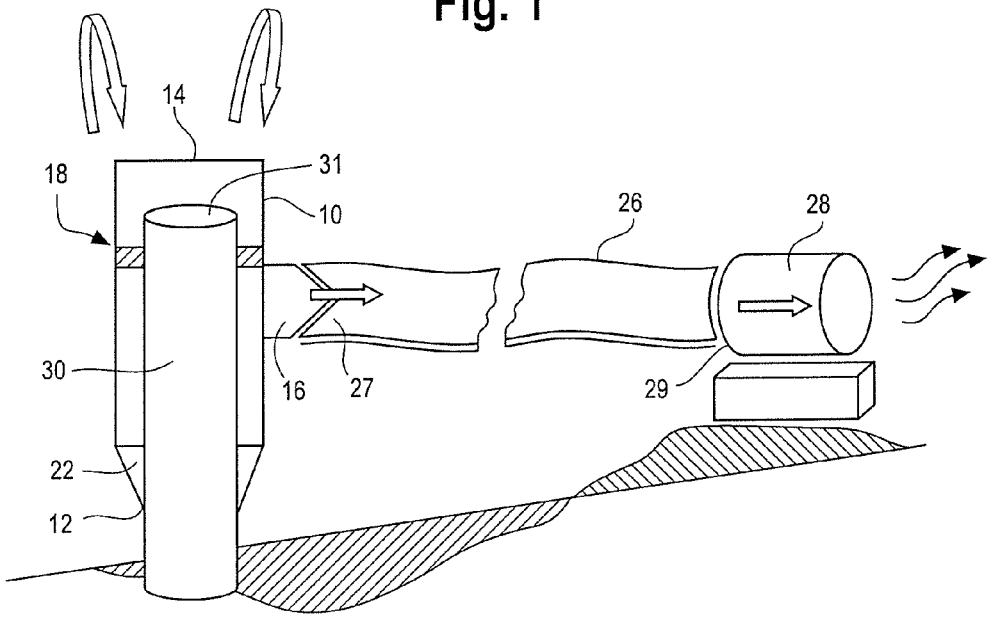
FIG. 1 is a view of a GasGuzzler well off gas venting device of this invention in operation.

As noted above, the GasGuzzler well off gas venting device will typically be installed around a gas well head near the ground such that the air inlet opening (14) is located above the open end of a LFG well head as show in FIG. 1. This facilitates a directed flow of air to pass by the top of the well bore pipe thereby actively "sweeping" the hazardous gas/air combination down through the device and out the discharge opening (16) and into ventilation duct (26) all under negative pressure (vacuum), induced using the an air moving device (28) such as a non-explosive exhaust fan. The highly diluted gas discharge will be directed "down wind" of the work area to prevent "blow back" toward the work zone. The unit will be properly grounded to prevent the build-up of static charges potentially induced by gas flow over the plastic surfaces which could otherwise result in a hazardous condition.

In operation, the venting devices of this invention are capable of directing most to essentially all hazardous gases such as flammable hydrocarbon gases and hydrogen sulfide that are emitted by an open well head or damaged gas pipe away from the well head or damage site and exhaust them as an air diluted gas. In operation, the well off gas venting devices are capable of reducing the concentration of hazardous gases including hydrogen sulfide when measured at the air inlet opening by at least 90% and up to 99% or greater in comparison to measurements taken at the air inlet opening when the air moving device is off.

Another advantage of the devices of this invention is that they dilute the hazardous gases with air to reduce the hazardous gas concentration in the diluted gas—when measured at the ventilation duct outlet by 80% and preferably by 90% or more in comparison to the concentration of hazardous gases including hydrogen sulfide at the air inlet opening with the air moving device is off.

The GasGuzzler can be constructed to serve as the storage and carrying device for the conductive flexible ventilation duct. This will prevent damage of the flexible ducting when not in use and serve as a storage device/carrying aide to consolidate items for field transport to the point An embodiment of a GasGuzzler well off gas venting device much like that shown in FIG. 3 was tested in the field. A landfill gas well was closed (isolated from vacuum source) and monitored until under positive pressure. The GasGuzzler prototype device such as that shown in FIG. 3 was then installed at the wellhead and the wellhead was removed. GasGuzzler was attached to extend 6-inches above the top of the well bore pipe for testing. Next, testing was performed for H2S values, using the Multi-RAE Lite Gas Analyzer. With the GasGuzzler off, the hydrogen sulfide in the gas emitted by the well when measured at the air inlet was 851 ppm. When the GasGuzzler was turned on, the amount of hydrogen sulfide measured at the air inlet was 0 ppm and continued to remain at 0 ppm for the 10 minute measuring duration. The amount of hydrogen sulfide in the gas in the ventilation duct exhaust gas was 66 ppm and varied from 66 to 69 during the 10 minute testing period.

What is claimed is:

1. A method for ventilating hazardous gases comprising the steps of:

a. placing a split column having a first opening, a second opening and a split that passes longitudinally through the split column from the first opening to the second opening around a gas well pipe;

b. attaching a ventilation duct having a first end and a second end to a discharge opening of the split column such that the ventilation duct first end is associated with the discharge opening and the ventilation duct second end is attached to a gas moving device to collect hazardous gases from the gas well pipe; and c. drawing air into the split column through the second opening with the gas moving device to dilute the hazardous gases from the gas well and directing the diluted hazardous gases into the ventilation duct and away from the split column.

2. The method of claim 1 wherein air enters the split column through the second opening which acts as an air inlet opening.

3. The method of claim 1 wherein the gas well pipe includes a gas well head.

4. The method of claim 1 wherein the gas moving device is engaged after the gas well head is removed to expose an end of the gas well pipe.

5. The method of claim 4 wherein the exposed gas well pipe end is located inside the split column.

6. The method of claim 5 wherein gas including hydrogen sulfide flows from the exposed end of the gas well pipe and wherein the concentration of hydrogen sulfide measured at the second opening of the split column is reduced by at least 90% when the gas moving device is engaged.

7. The method of claim 6 wherein engaging the gas moving device dilutes the hydrogen sulfide gas with air to an extent sufficient to reduce the hydrogen sulfide content of the gas at the ventilation duct outlet to less than 20% of the concentration of hydrogen sulfide in the gas flowing from the exposed end of the gas well.

8. The method of claim 1 wherein the split column split includes a first split edge and a second split edge and wherein the first split edge and second split edge are urged away from one another to form a gap before the split column is placed around a gas well pipe.

9. The method of claim 1 wherein the split column is removed from the gas well pipe by the further steps of:

turning off the gas moving device;

detaching the ventilation duct first end from the ventilation duct discharge opening; and urging the first split edge away from the second split edge to form a gap and removing the split column from around the gas well pipe.

10. A well off gas venting device comprising:

a split column having a first opening and a second opening at opposing ends of the split column, the split column further including a split that passes through the tubular section and that extends from the first opening to the second opening; and a third opening in the split column that is located between the first opening and the second opening wherein the split column has an inside surface having at least two offset centralizers located at essentially the same axial location along the length of the split column at least one centralizer having a length that is less than the length of the tubular section.

11. The well off gas venting device of claim 10 including one or more closures.

12. The well off gas venting device of claim 10 wherein a duct first end is associated with the third opening.

13. The well off gas venting device of claim 12 wherein the duct has a second end that is associated with one or more gas moving devices.

14. The well off gas venting device of claim 13 wherein the one or more gas moving devices are fans, blowers, vacuum pumps or any combination thereof.

15. The well off gas venting device of claim 10 including three centralizers attached to the inside surface of the split column and space apart from one another by approximately 120°.

16. The well off gas venting device of claim 10 including a fourth opening located on the split column between the first and second opening wherein the third opening acts as an air inlet opening and the fourth opening acts as gas discharge opening.

17. The well off gas venting device of claim 10 further including a seal at the first opening.

* * * * *